US005097791A

United States Patent [19]

Barrois et al.

[11] Patent Number: 5,097,791

[45] Date of Patent: Mar. 24, 1992

[54] APPARATUS FOR INVALIDATING SECURITY PRINTS PRINTED ON PRINT CARRIERS

[75] Inventors: Claus D. Barrois, Erlenbach; Philipp A. Dieterich, Randersacker, both of Fed. Rep. of Germany

[73] Assignee: De La Rue Giori S.A., Lausanne, Switzerland

[21] Appl. No.: 636,222

[22] Filed: Dec. 31, 1990

[30] Foreign Application Priority Data

Jan. 17, 1990 [CH] Switzerland ..... 139/90-5

[51] Int. Cl.[5] ..... B05B 3/02

[52] U.S. Cl. ..... 118/313; 239/220; 118/DIG. 16

[58] Field of Search ..... 239/220, 222; 118/302, 118/313, 315, 324, 670, DIG. 16; 427/7

[56] References Cited

U.S. PATENT DOCUMENTS 2,199,093 9/1940 Wolfendon ..... 239/220

4,040,385 8/1977 Tost ..... 118/DIG. 16

*Primary Examiner*—Richard V. Fisher

*Assistant Examiner*—Charles K. Friedman

*Attorney, Agent, or Firm*—Kane, Dalsimer, Sullivan, Kurucz, Levy, Eisele and Richard

[57] ABSTRACT

The apparatus has as many invalidating units (E) arranged next to one another as there are longitudinal rows of security prints on the print carriers (P). Each invalidating unit (E) has a stand (1), a trough (3) vertically displaceable in the latter and intended for receiving ink (4), a centrifugal wheel (7) rotating continuously above the trough (3), and a shutter (11) which interacts with an orifice (10) of a cowl (9) covering the centrifugal wheel (7). By means of a controlled actuating member (6), the trough (3) is adjustable between a raised working position, in which the centrifugal wheel (7) dips into the ink and the shutter (11) exposes the orifice (10), and a lowered position of rest, in which the centrifugal wheel (7) does not dip into the ink and the orifice (10) is covered by the shutter (11). Control takes place whenever a security print previously detected as a misprint and to be invalidated in one or more longitudinal rows of the print carriers passes the orifice (10) of the respective invalidating unit, so that this misprint is sprayed with ink by the centrifugal wheel (7) through the orifice (10) which is then free.

9 Claims, 3 Drawing Sheets

APPARATUS FOR INVALIDATING SECURITY PRINTS PRINTED ON PRINT CARRIERS

FIELD OF THE INVENTION

The invention relates to an apparatus for invalidating security prints printed on print carriers, with at least one ink reservoir and with at least one device for applying ink to security prints detected as misprints.

PRIOR ART

An invalidation apparatus of this type, in the form of an invalidating printing unit, is mentioned in EP-B-0,167,196 of the same applicant in conjunction with a method of processing security webs or security sheets to form security bundles. According to this method, print carriers which are printed with security prints and are in the form of security webs or security sheets and the security prints of which are arranged in matrix form in transverse rows and longitudinal rows are first inspected to ascertain whether there are any misprints. The security prints detected as misprints are provided with a marking readable by a detector. For processing purposes, the print carriers run past a reader which, in order to check all the longitudinal rows, has as many detectors as there are longitudinal rows. These detectors read the markings on the misprints and enter their positions in a computer where these misprint positions are stored. The print carriers then pass into the invalidating printing unit which is controlled by this computer and which prints all the misprints with an invalidating overprint. The print carriers subsequently run through a numbering machine, in which only the perfect security prints are numbered consecutively. The print carriers are thereafter cut into individual securities, and the misprints identified clearly as rejects by the invalidating overprint are separated out, whilst the perfect securities are combined to form bundles with a complete numerical sequence. The detailed construction of this invalidating printing unit and its mode of control are not described in EP-B-0,167,196.

There are already known invalidation apparatuses Which work with controlled ink spray nozzles, so that the print carrier moved past therefore need not touch the apparatus mechanically. However, the disadvantage of these ink spray nozzles is that they easily become clogged, especially by the ink which dries after a lengthy standstill time or during an operational interruption, thus making frequent cleaning and maintenance necessary.

SUMMARY OF THE INVENTION

The object on which the present invention is based is to provide an improved invalidation apparatus free of contact of the type mentioned, in which there is virtually no possibility of clogging by drying ink and which is of simple design and simple to control and moreover is easy to maintain.

According to the invention, this object is achieved by the fact that the ink reservoir is a trough which is installed so as to be vertically displaceable in a stand and which is adjustable by means of a controlled actuating member between a lower position of rest and an upper working position, that the device for applying the ink is a centrifugal wheel which continuously rotates during operation and which is arranged in the stand above the trough on a horizontal drive shaft and is covered by a cowl having an orifice, in front of which the print carriers are moved past, that this centrifugal wheel is located above the ink level in the position of rest of the trough, but dips into the ink in the working position of the trough, and that there is an adjustable shutter which is movable in synchronism with the trough and which exposes the orifice of the cowl in the working position of the trough, but covers this orifice in the position of rest of the latter.

In the apparatus according to the invention, narrow nozzle-like orifices for the passage of the ink and therefore possible clogging are reliably avoided. Furthermore, the centrifugal wheel dips into the ink only during the very short period of time of the actual invalidating operation, but is otherwise always located outside the ink, so that no undesirable ink layer can settle on this centrifugal wheel. The conditions for each invalidation are therefore the same and are not changed during lengthy operation by an increasing soiling of the centrifugal wheel with ink.

Preferably, moreover, there is also an adjustable doctor which, in the position of rest of the trough, bears against the centrifugal wheel and strips off the ink adhering to this, whilst in the working position the doctor is removed from the centrifugal wheel.

Further expedient embodiments of the invention emerge from the dependent patent claims.

BRIEF DESCRIPTION OF THE DRAWINGS

The invention is explained in more detail by means of an exemplary embodiment with reference to the drawings. In these.

DESCRIPTION OF THE PREFERRED EMBODIMENTS

Figure 1:
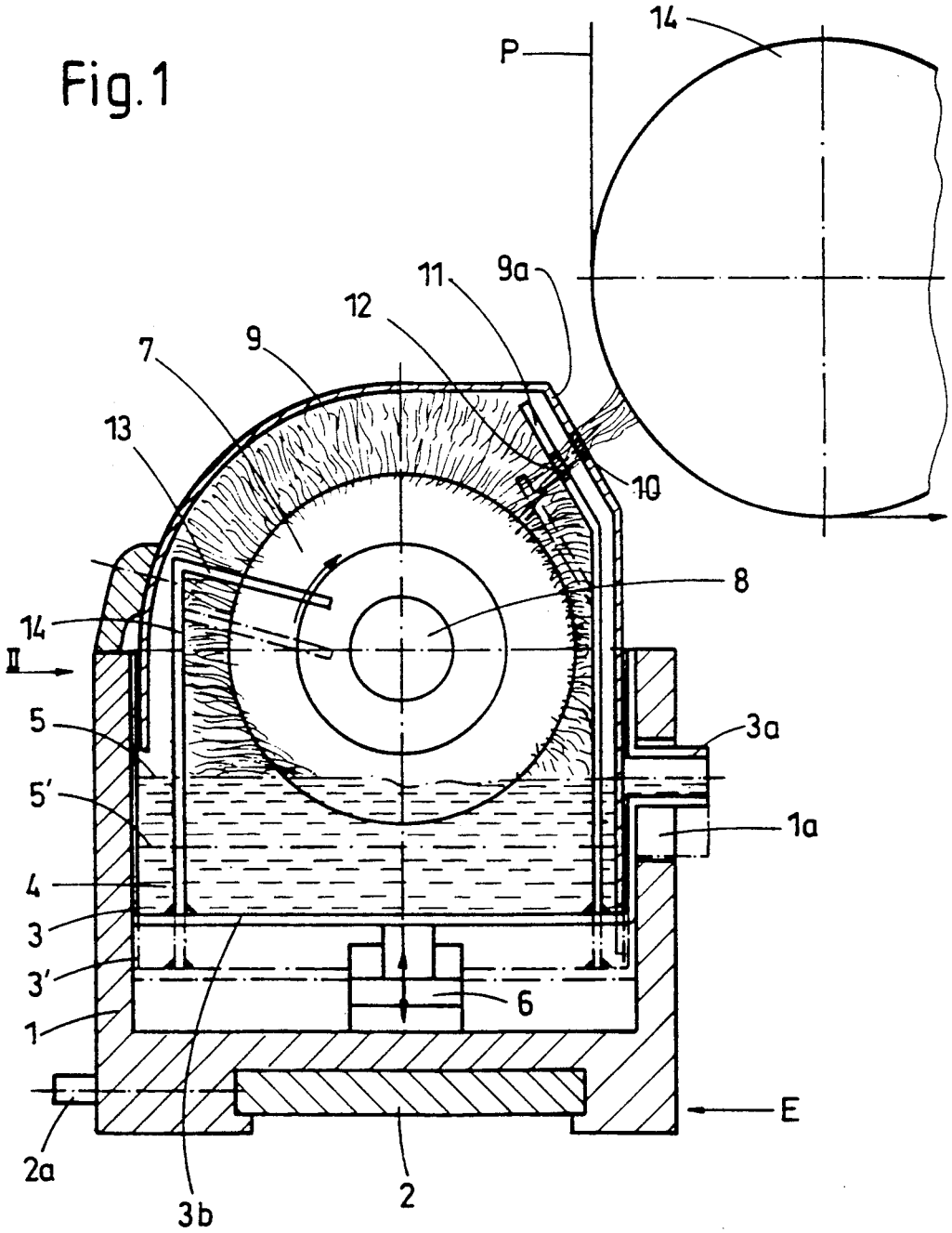
FIG. 1 shows a side view of an apparatus according to the invention taken in a section along the line I—I according to FIG. 2 and showing the interior of one of a plurality of invalidating units of the apparatus.
Figure 2:
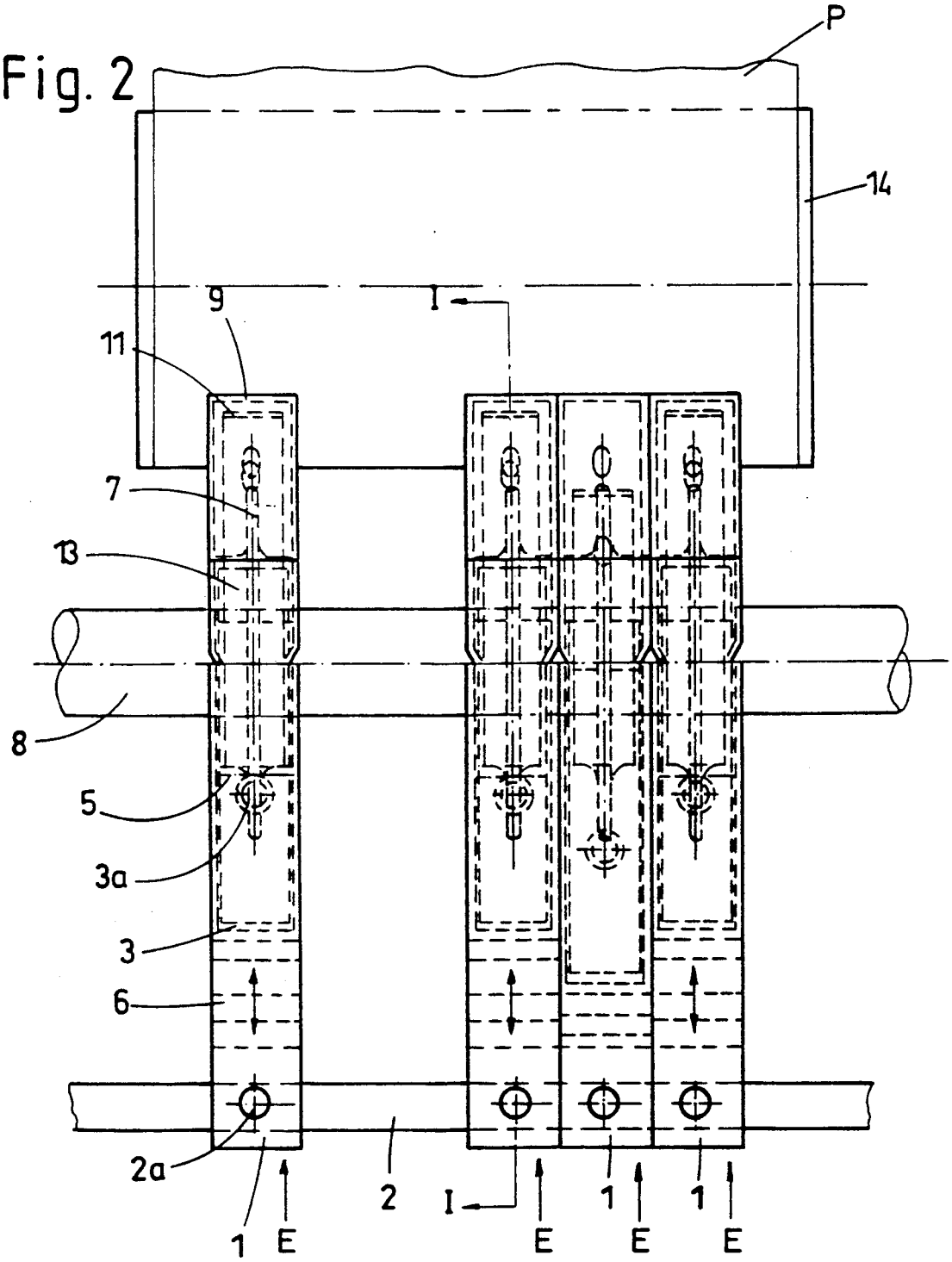
FIG. 2 shows a view of the apparatus in the direction of the arrow II according to FIG. 1.

According to FIGS. 1 and 2, the apparatus has a plurality of invalidating units E which are arranged next to one another and are all of the same design and past which print carriers running over a transport cylinder 14 are guided in the direction of the arrow (FIG. 1). The example under consideration relates to a print carrier P in the form of a paper web, on which security prints, for example banknote or postage-stamp prints, are printed in matrix form in longitudinal and transverse rows. In this connection, there are as many invalidating units E as the paper web has longitudinal rows extending in the direction of transport, one invalidating unit E being arranged in front of each longitudinal row. The apparatus according to FIG. 2 shows four invalidating units E, the left-hand invalidating unit being shown at a distance from the others, in order to illustrate that their positions are individually adjustable.

According to FIG. 1, each invalidating unit E consists of a stand 1, of a vertically displaceable trough 3 intended for receiving ink 4, of a centrifugal wheel 7 which is arranged on a horizontal drive shaft 8 installed above the trough 3 and which is covered by a cowl 9 fastened to the stand 1, and of a vertically adjustable shutter 11. All the stands 1 of the apparatus are arranged displaceably on a common crossmember 2 oriented parallel to the axis of the transport cylinder 14 and can be fixed in the desired position by means of a respective screw 2*a*. The centrifugal wheels 7 of all the invalidating units E are arranged on a common drive shaft 8 and rotate continuously.

Figure 3:
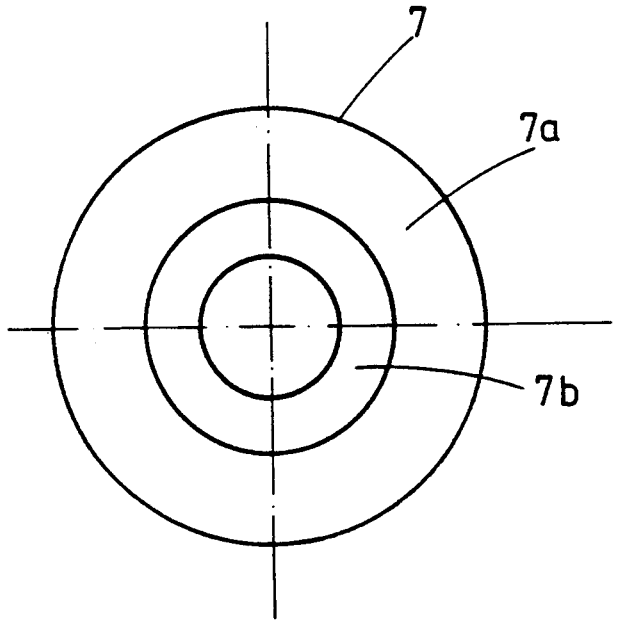
FIG. 3 shows a side view of an individual centrifugal wheel of the apparatus according to FIGS. 1 and 2.
Figure 4:
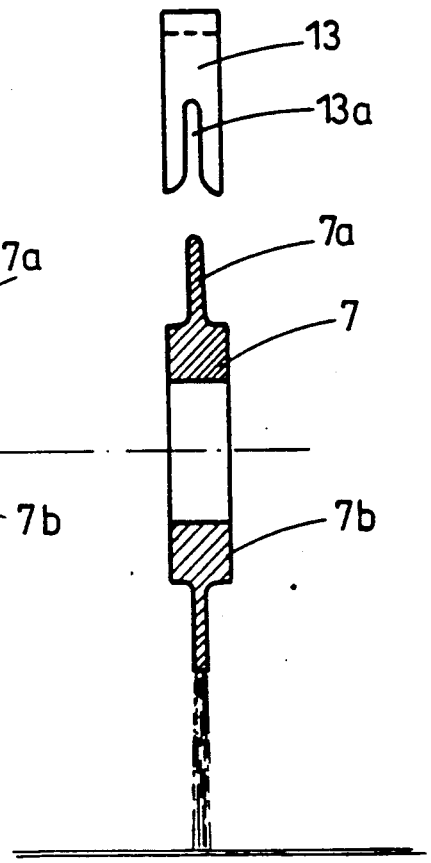
FIG. 4 shows an axial section through the centrifugal wheel according to FIG. 3, together with a diagrammatic representation of the adjustable doctor and of the ink thrown off on the opposite side.

According to FIGS. 3 and 4, each centrifugal wheel 7 has a circumferential region 7*a* which is in the form thin disk and which is formed on a substantially thicker hub 7*b*, itself arranged fixedly in terms of rotation on the drive shaft 8 common to all the centrifugal wheels 7. Should the security prints be postagestamp prints, the apparatus according to the figures is shown on the scale 1:1, that is to say the disk-shaped circumferential region 7*a* of the centrifugal wheel has a thickness of only approximately 2 mm, whilst the width of a stand 1 amounts to approximately 18 mm.

According to FIG. 1, by means of an actuating member 6 the trough 3 is adjustable vertically between a raised working position represented by unbroken lines and a lowered position of rest 3' indicated by dot-and-dash lines. In the example under consideration, the actuating member 6 is a cylinder operated by pressure medium, specifically a pneumatic cylinder. In the raised working position of the trough 3, the ink level 5 is so high that the centrifugal wheel 7 dips into the ink 4 with its region 7*a*. In contrast, in the lowered position of rest of the trough 3, the ink level 5' is so low that the centrifugal wheel 7 does not dip into the ink 4.

The cowl 9 has an inclined wall portion 9*a* located at a short distance in front of the circumference of the transport cylinder 14 and having an orifice 10. In the example under consideration, the shutter 11 is fastened to the bottom 3*b* of the trough 3 and consists of a narrow plate which is oriented essentially vertically and the upper region of which has a perforation 12 and is angled so that it extends parallel to the inclined wall portion 9*a* of the cowl 9. In the working position of the trough 3, the perforation 12 of the shutter represented by unbroken lines is in line with the orifice 10 of the cowl 9; in contrast, in the position of rest of the trough 3, the orifice 10 is covered by the shutter 11 indicated by dot-and-dash lines. By means of a lateral connection piece 3*a* of the trough 3 which serves as an inflow and overflow and which passes through a long hole 1*a* of the stand the trough 3 is always supplied with a sufficient quantity of ink 4, so that the height of the ink level within the trough 3 remains at least approximately constant.

In the example under consideration, moreover, there is a doctor 13 which interacts with the centrifugal wheel 7 on the side of the latter opposite the shutter 11 and which forms the upper angled part of an otherwise essentially vertically oriented post 14 likewise fastened to the bottom 3*b* of the trough 3. The profile of this doctor 30 is matched to the profile of the centrifugal wheel 7 and therefore in the example under consideration, as shown in FIG. 4, has a slot 13*a*, the width of which is matched to the thickness of the circumferential region 7*a* of the centrifugal wheel 7. In the working position of the trough 3, the doctor 13 adjustable together with this trough 3 is raised so far that it is removed from the centrifugal wheel 7 rotating in the direction of the curved arrow according to FIG. 1, but in the rest position of the trough 3 the doctor 13 bears against the centrifugal wheel 7, in that the region 7*a* engages into the slot 13*a*, so that the ink is stripped off from the centrifugal wheel 7 when it emerges from the trough 3.

When the apparatus is in operation, the actuating members 6 are controlled individually by means of control valves (not shown) as a function of the positions on the paper web of those security prints which have been detected as misprints and which are therefore to be invalidated by ink sprayed on them. Whenever a misprint to be invalidated in one or more of the longitudinal rows of the paper web passes the respective invalidating unit E, that is to say is moved past in front of the respective orifice 10, the actuating member 6 then briefly operated raises the trough 3, till then located in its lower position of rest, into its upper working position. The shutter thereby exposes the orifice 10, the doctor 13 is removed from the centrifugal wheel 7 and this centrifugal wheel 7 now dips into the ink 4, so that the ink thrown off from the circumference of the centrifugal wheel 7 and indicated diagrammatically in FIG. 1 is sprayed through the perforation 12 and the orifice 10 onto the respective security print. Before the next security print not to be invalidated passes the orifice 10, the actuating member 6 returns the trough 3 into its lower position of rest, so that the ink level falls below the centrifugal wheel 7 and the shutter 11 covers the orifice 10; the ink then still being thrown off by the centrifugal wheel 7 can therefore no longer come out of the cowl 9. At the same time, the doctor 13 then bearing against the centrifugal wheel 7 strips off the ink still adhering to it, so that no thickening or drying ink layers can settle on the centrifugal wheel 7 in the position of rest of the apparatus.

In the representation according to FIG. 2, only the trough 3 of the second invalidating unit E from the right assumes its position of rest, whilst the troughs 3 of the other invalidating units assume their raised working position.

When a plurality of immediately succeeding security prints of a longitudinal row are to be invalidated, the respective trough 3 then of course remains in its raised working position for the corresponding period of time. Thus, for example where sheets of postage stamps are concerned, it is possible, if necessary, to invalidate an entire longitudinal row.

The individual control of the actuating member 6 is advantageously carried out, as mentioned in the description introduction, by a computer in which the positions of the security prints to be invalidated on the print carriers are stored and which temporarily opens the control valve of the respective actuating member 6 at the correct moment. As likewise mentioned in the description introduction, the storage of the misprint positions in the computer takes place, for example, by means of optical detectors which locate the security prints previously provided with markings as a result of a visual inspection, or by means of test detectors which automatically conduct a quality check on the security prints and enter the positions of detected misprints in the computer for storage.

The invention is not restricted to the exemplary embodiment described, but permits many alternative versions as regards the design and arrangement of the actuating member, centrifugal wheel, shutter and doctor. Thus, the shutter and doctor could also be displaced by their own actuating members moved in synchronism with the trough, and, for example, the movement of the doctor could take place essentially horizontally. Of course, the print carriers can also be security sheets or individual securities.

We claim:

1. Apparatus for invalidating security prints printed on print carriers, with at least one ink reservoir and with at least one device for applying ink to security prints detected as misprints, wherein said ink reservoir is a trough (3) which is installed so as to be vertically displaceable in a stand (1) and which is adjustable by means of a controlled actuating member (6) between a lower position of rest and an upper working position, said at least device for applying the ink being a centrifugal wheel (7) which continuously rotates during operation and which is arranged in said stand (1) above said trough (3) on a horizontal drive shaft (8) and is covered by a cowl (9) having an orifice (10), in front of which said print carriers (P) are moved past, said centrifugal wheel (7) being located above the ink level (5') in the position of rest of said trough (3), but dips into the ink (4) in the working position of said trough (3), and wherein there is an adjustable shutter (1) which is movable in synchronism with said trough (3) and which exposes said orifice (10) of said cowl (9) in the working position of said trough (3), but covers said orifice (10) in the position of rest of the latter.

2. Apparatus according to claim 1, wherein furthermore, in the stand (1) there is an adjustable doctor (13) interacting with the centrifugal wheel (7) and having a profile matched to the profile of the centrifugal wheel, and in that this doctor (13) bears against the centrifugal wheel (7) in the position of rest of the trough (3), in front of the orifice (10), as seen in the direction of rotation of the said wheel, but is removed from the centrifugal wheel in the working position of the trough (3).

3. Apparatus according to claim 2, wherein the doctor (13) is mounted on a post (14) fastened to the trough (3).

4. Apparatus according to claim 1, wherein the circumferential region (7*a*) of the centrifugal wheel (7), which dips at least partially into the ink in the working position of the trough (3), consists of a thin annular disk, the thickness of which 1 to 3 mm.

5. Apparatus according to claim 2, wherein the doctor (13) is equipped with a slot (13*a*) which opens out at its front edge and the width of which is matched to the thickness of the circumferential region (7*a*) of the centrifugal wheel (7).

6. Apparatus according to claim 1, wherein the shutter (11) is a plate which is fastened to the bottom of the trough (3), and the upper region of which is located in front of the orifice (10) of the cowl (9) and has a perforation (12) which only in the working position of the trough (3) is aligned with the orifice (10) of the cowl (9), the wall portion (9*a*) of the cowl (9) having the orifice (10) being inclined, and the upper region of the shutter (11) having the perforation (12) extending parallel to this.

7. Apparatus according to claim 1, wherein the actuating member (6) is a cylinder operated by pressure medium and controlled via a control valve.

8. Apparatus according to claim 1, for invalidating security prints printed in longitudinal and transverse rows on print carriers, the longitudinal rows extending in the direction of movement of the print carriers, wherein as many stands (1), each equipped with a trough (3), actuating member (6), centrifugal wheel (7), shutter (11) and, if appropriate, doctor (13), are arranged next to one another as there are longitudinal rows of security prints on the print carriers, the width of each stand (1) being at most equal to the width of one longitudinal row of the security prints, and the movements of all the troughs can be controlled individually as a function of misprints present in one or more longitudinal rows.

9. Apparatus according to claim 8, wherein all the stands (1) are fastened adjustably on a common cross-member (2), and all the centrifugal wheels (7) are arranged on a common drive shaft (8).

* * * * *